US008701684B2

(12) United States Patent
Muhl et al.

(10) Patent No.: US 8,701,684 B2
(45) Date of Patent: Apr. 22, 2014

(54) BRUSH, IN PARTICULAR FOR THE APPLICATION OF COLOURS, DYES OR ANY OTHER COMPOSITIONS ONTO A SURFACE

(75) Inventors: Till Nikolas Muhl, Hamburg (DE); Guenter Wissmann, Schenefeld (DE)

(73) Assignee: KAO Germany GmbH, Darmstadt (DE)

( * ) Notice: Subject to any disclaimer, the term of this patent is extended or adjusted under 35 U.S.C. 154(b) by 203 days.

(21) Appl. No.: 12/864,938

(22) PCT Filed: Feb. 4, 2009

(86) PCT No.: PCT/EP2009/051240

§ 371 (c)(1),
(2), (4) Date: Nov. 3, 2010

(87) PCT Pub. No.: WO2009/098217

PCT Pub. Date: Aug. 13, 2009

(65) Prior Publication Data

US 2011/0035895 A1 Feb. 17, 2011

(30) Foreign Application Priority Data

Feb. 7, 2008 (EP) ..... 08002267

(51) Int. Cl.
*A45D 24/16* (2006.01)

(52) U.S. Cl.
USPC ..... 132/120; 15/143.1

(58) Field of Classification Search
USPC ..... 132/120, 121, 148, 150; 15/143.1; 16/430, 436, DIG. 12, DIG. 19
See application file for complete search history.

(56) References Cited

U.S. PATENT DOCUMENTS

| | | | | |
|---|---|---|---|---|
| 2,602,457 | A * | 7/1952 | Mele | 132/120 |
| 3,133,546 | A | 5/1964 | Dent | |
| 3,833,008 | A | 9/1974 | Blackett | |
| 4,542,552 | A | 9/1985 | D Argembeau | |
| 2004/0139569 | A1 * | 7/2004 | Chen | 15/143.1 |
| 2008/0092337 | A1 * | 4/2008 | Gross | 16/430 |

FOREIGN PATENT DOCUMENTS

| | | | |
|---|---|---|---|
| DE | 8914873 | U1 | 2/1990 |
| DE | 20107703 | U1 | 9/2001 |
| EP | 0193059 | A | 3/1986 |
| EP | 0290206 | A | 11/1988 |
| EP | 0761125 | A | 3/1997 |
| WO | 03/005855 | A | 1/2003 |

OTHER PUBLICATIONS

International Search Report Dated May 7, 2009.

* cited by examiner

*Primary Examiner* — Rachel Steitz
(74) *Attorney, Agent, or Firm* — Norris McLaughlin & Marcus, P.A.

(57) ABSTRACT

The present invention pertains to a brush (1), in particular for the application of colors, dyes or any other composition onto a surface, in particular onto hair. The brush includes a handle (2) for the brush to be held by a user and a brush head (3) including bristles (32) for the application of colors, dyes or other composition onto the surface, the brush head being connected to the handle. The handle (2) includes at least one gripping section (20) showing a substantially polygonal cross-section.

16 Claims, 3 Drawing Sheets

Fig. 2
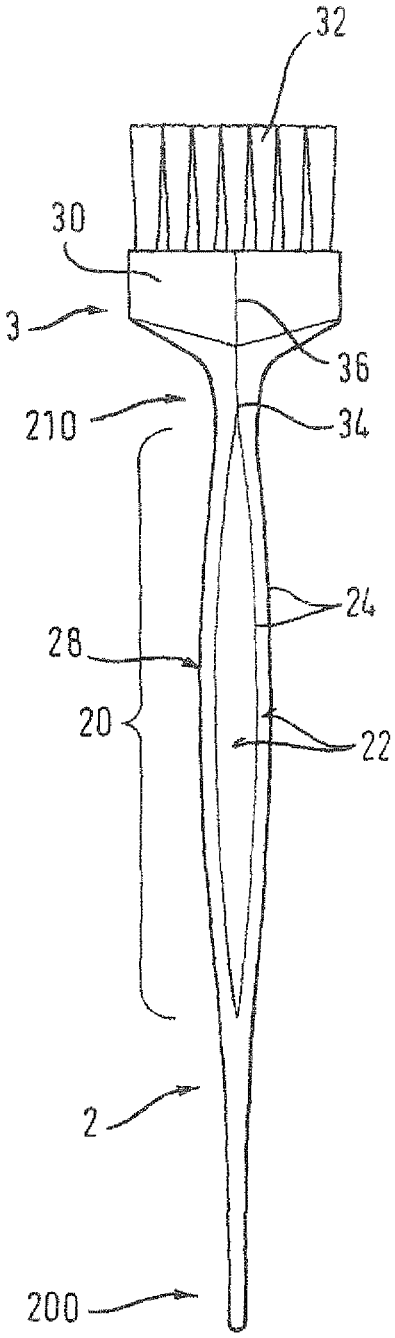
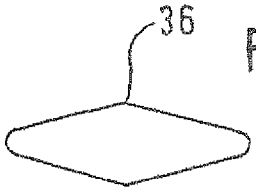
Fig. 4a
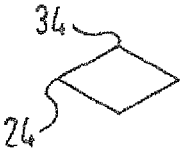
Fig. 4b
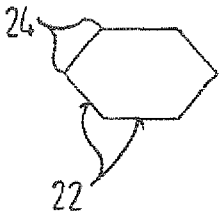
Fig. 4c
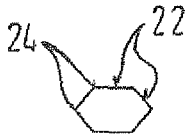
Fig. 4d
Fig. 4e
Fig. 3
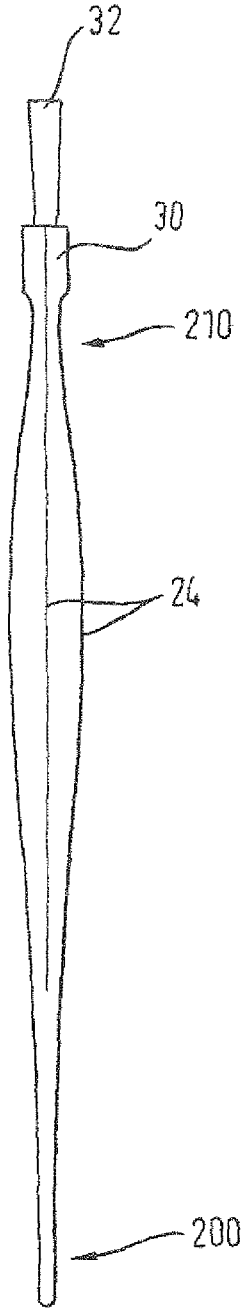

BRUSH, IN PARTICULAR FOR THE APPLICATION OF COLOURS, DYES OR ANY OTHER COMPOSITIONS ONTO A SURFACE

This application is a 371 application of PCT/EP2009/051240 filed Feb. 4, 2009, which claims priority to the EP application 08002267.6 filed Feb. 7,2008.

TECHNICAL FIELD

The present invention relates to a brush, in particular for the application of colours, dyes or any other compositions onto a surface, in particular onto hair. The brush will typically be used for painting objects or in a hair colouring service in a hair saloon, in particular by a hairdresser or hair technician.

TECHNOLOGICAL BACKGROUND

For the application of a colouring mass, colouring dyes, colouring emulsions or other forms of hair treatment compositions, in the majority of applications a brush is used. When using this technology, the hair stylist or the hair technician applies by means of the brush the respective colouring mass or the treatment composition to the portions of the hair that are to be coloured or otherwise treated. In particular for the application of different hair treatment compositions in different areas of the hair, e.g. for the application of highlights into the hair, brushes are particularly suitable.

During the actual treatment of hair, the hair stylist or hair technician typically focuses onto the hair to be treated and has, thus, a visual control of the actual orientation of the brush head and the bristles of the brush with respect to the hair to be treated.

However, a haptic feedback mechanism which would enable the hair stylist to control the orientation of the brush head without the need of visual inspection, would improve the overall handling of the brush, in particular when the hair stylist at the same time converses with the customer.

In other applications of the brush, a clear haptic feedback would also enable a user to clearly control the orientation of the brush with respect to a surface onto which a colour, dye or any other composition is to be applied.

DISCLOSURE OF THE INVENTION

Accordingly, an object of the present invention is to provide a brush, in particular for the application of colours, dyes or any other compositions onto a surface, wherein the brush has an improved handling and control.

This object is solved by a brush according to the subject-matter of claim 1.

In particular, a brush, in particular for the application of colours, dyes or any other compositions onto a surface, in particular onto hair, includes a handle for the brush to be held by a user and a brush head which includes bristles for the application of the colours, dyes or other compositions onto the surface. According to the invention, the handle includes at least one gripping section showing a substantially polygonal cross-section.

By the provision of a handle which includes at least one gripping section showing a substantially polygonal cross-section, a haptic feedback of the handle towards the user of the brush can be significantly improved. In particular, owing the substantially polygonal cross-section, the gripping section has a number of edges and corners which give the user a clear feedback as to the orientation of the brush head and, thus, with respect to the orientation of the bristles. This clearly improves the overall handling of the brush in real-life working conditions.

In a preferred embodiment, the polygonal cross-section is one of a tetragon, pentagon, heptagon, octagon or nonagon, in particular of a regular tetragon, pentagon, heptagon, octagon or nonagon. In a yet preferred embodiment, the polygonal cross-section is a hexagon, in particular a regular hexagon. Due to the limited number of edges and corners in the mentioned polygons, the user, in particular the hair stylist, is in a position to haptically distinguish the different edges and corners of the handle and, thus, can clearly determine the orientation of the brush head, even when wearing gloves.

In a preferred embodiment of the brush, the polygonal cross-section has an even number of corners. Due to the provision of an even number of corners it is possible to provide the handle with a substantially symmetrical appearance whilst, at the same time, it still enables the user to clearly determine the orientation of the brush head. This is particularly advantageous when the brush head has a symmetrical shape and is symmetrically positioned with respect to the handle, e.g. in a situation in which the brush head includes a number of bristle bundles which are placed adjacent to each other in a plane extending perpendicular to the general extension of the handle.

In order to yet improve the haptic feedback of the gripping section of the handle towards the user by providing different portions of the gripping section, the polygonal cross-section is present in a portion of the gripping section in its longitudinal direction only.

Preferably, the brush is a hair treatment brush for the application of a colouring mass or any other hair treatment composition onto hair. The specific design of the brush renders it particularly suitable for this application as the hairdresser or the hair technician can clearly make use of the haptic feedback provided by the specific shape of the gripping section.

In another preferred embodiment, the gripping section includes a substantially bulbous portion. By the term "bulbous portion" it will be understood that along the longitudinal extension of the handle, there is at least one portion having a maximum diameter and in both directions extending from this portion of maximum diameter there are portions with a diameter smaller than the maximum diameter.

The portion of maximum diameter preferably is spaced apart by one half to one third of the overall length of the handle including the brush head, excluding the bristles, from the end of the handle that does not carry the brush head.

Preferably, the gripping section shows a substantially convex shape along its longitudinal direction.

By the specific embodiments of the bulbous portion and/or the convex shape, the handling of the brush can be further improved. This is due to the fact that the user can grip the handle in the gripping section and does not easily slip along the handle when it is wet or soiled due to the bulbous portion and/or the convex shape. In combination with the polygonal cross-section which is present in the gripping section, this leads to a unique gripping experience and the gripping section provides improved feedback as to the orientation of the brush head at the same time.

In addition to that, the provision of the bulbous portion and/or the convex shape leads to a brush which can be finely balanced, i.e. the weight distribution/mass distribution in the longitudinal direction of the gripping section and, thus, of the brush can be adapted to the needs of a user. By the provision of the bulbous portion and/or the convex shape, the centre of gravity can be shifted further towards that end of the handle that does not carry the brush head. The additional mass provided by the bulbous portion and/or the convex shape can counter-balance the weight of the brush head which is typically soaked with the agent to be applied.

In another preferred embodiment, the handle of the brush tapers towards that end of the handle which does not carry the brush head. It is preferred that the polygonal cross-section of the gripping section smoothly merges into a circular cross-section towards that end of the handle which does not carry the brush head. This results in a tapered end which has a circular cross-section at the end of the handle that does not carry the brush head. This end can be used by the hair stylist or hair technician to select certain parts of the hair to be treated, in particular in order to provide highlights to certain parts of the hair.

In a preferred embodiment, at least two of the corners of the polygonal cross-section of the gripping section merge into a single corner in a portion of the handle situated towards at least one of the ends of the handle.

Preferably, the brush head includes a rigid portion which extends substantially in a plane orthogonal to the longitudinal extension of the handle. Preferably, the rigid portion of the brush head shows a substantially polygonal cross-section. In a particularly advantageous embodiment, the rigid part of the brush head has a substantially wedge shaped cross-section and/or a convex form in a plane orthogonal to the longitudinal extension of the handle. By this specific embodiment of the rigid portion of the brush head, a widely-known phenomenon can be avoided, namely the piling up of the colouring mass or the other application composition in the center of the rigid part of the brush head. Due to the generally convex shape of the rigid part of the brush head, an even distribution of any colouring mass or other application composition which might be located in the center of the rigid portion of the brush head can be achieved as it is guided towards the sides of the rigid portion of the brush head.

In the brush head, it is preferred that the individual bristle bundles of the bristles are placed adjacent to one another in the plane which is defined by the rigid portion of the brush head and extend along the longitudinal direction of the handle.

Preferably, and in order to further improve the haptical feedback of the brush towards the user, the gripping section has a polygonal cross-section with a number of corners larger than the number of corners of any other polygonal cross-section of the handle. By this specific embodiment, the user can clearly judge from the number of corners, which part of the handle she or he is currently gripping. This improves the haptical feedback of the handle along its longitudinal direction. in combination with the polygonal cross-section of the gripping section and in particular the bulbous portion and/or convex shape of the gripping section, the user receives a clear haptical feedback of the overall orientation of the brush, not only with respect to the rotational orientation of the handle but also with respect to the lengthwise longitudinal orientation.

In one further development, the brush further includes a comb, which is particularly suitable for using the brush as a hair treatment brush. The teeth of the comb preferably extend substantially perpendicular to the extension of the handle. When choosing this embodiment, the comb is basically integrated with the brush head but the bristles of the brush extend in the direction opposite to the direction of the extension of the teeth of the comb. In one further preferred embodiment, the bristles extend in an angle to the extension of the teeth of the comb. This combined brush/comb provides the hair stylist with a very efficient tool for the application of a colouring mass or other hear treatment composition onto hair.

BRIEF DESCRIPTION OF THE DRAWINGS

The invention will be further described, by way of example only, with reference to the accompanying schematic drawings, in which:

FIG. 2 is a schematic top view on the hair treatment brush of FIG. 1.

FIG. 3 is a schematic side view on the hair treatment brush of FIGS. 1 and 2.

FIGS. 4*a* to 4*e* are schematic cross-sections of the hair treatment brush according to FIGS. 1 to 3.

DETAILED DESCRIPTION OF PREFERRED EMBODIMENTS

Figure 1:
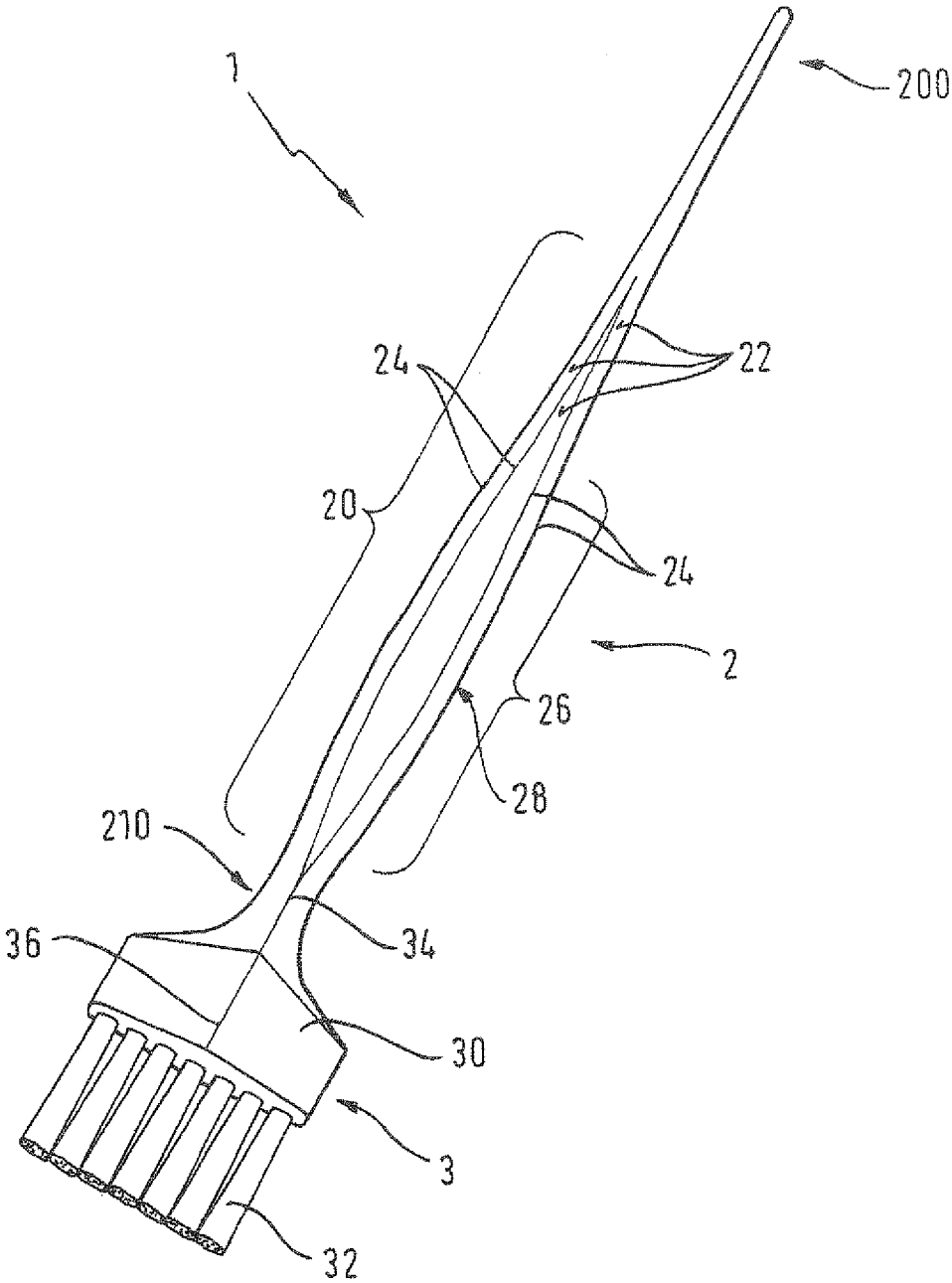
FIG. 1 is a schematic perspective drawing of a brush, in particular a hair treatment brush, in a first embodiment.

In the following, similar features in the exemplary embodiments are indicated by the same reference numerals in the different drawings and repeated description thereof is omitted.

FIG. 1 shows a schematic perspective view of a brush 1 which is exemplary shown in an embodiment for a hair treatment brush for the application of a colouring mass or any other hair treatment compositions onto hair according to a first embodiment. FIGS. 2 and 3 show a top view and a side view, respectively, of the hair treatment brush 1 of FIG. 1.

Naturally, the hair treatment brush 1 shown in the Figures can also be used for other applications, in particular for painting surfaces.

The hair treatment brush 1 includes a handle, which is generally indicated by the reference numeral 2, and a brush head, which is generally indicated by reference numeral 3.

The handle 2 is for holding the hair treatment brush by a user, in particular by a hair stylist or hair technician, which intends to apply a colouring mass or any other hair treatment compositions onto the hair of a customer. Naturally, the hair treatment brush can also be used in a private household but, typically, the main application takes place in commercial hair saloons.

The brush head 3 includes a rigid part 30 which serves to fix and hold a number of bundles of bristles 32, which are situated adjacent to one another basically in the plane that is defined by the largest lateral extension of the rigid part 30 of the brush head 3. The bristles 32 are intended for the application of the respective colouring mass or any other hair treatment composition which is to be applied to the surface to be treated, in particular to hair.

The handle 2 in the embodiment shown in FIG. 1 includes a gripping section 20 which is typically the section in which the user mainly grips the hair treatment brush 1. This gripping section shows a substantially polygonal cross-section. In the embodiment shown in FIG. 1, six edges 22, three of which are shown in the perspective view of FIG. 1, and six corners 24, four of which are shown in the perspective view of FIG. 1, are included in the gripping section 20. In other words, the polygonal cross-section is a hexagon.

The specific polygonal shape of the gripping section 20 of the handle enables the user to receive a haptic feedback from the gripping section as to the rotational orientation of the brush head 3. In other words, the gripping section 20 of the embodiment shown in FIG. 1 has a basically hexagonal cross-section which can be easily distinguished by the user.

However, the polygonal cross-section may be also present in a portion of the gripping section in the longitudinal direction only.

However, polygons with a lower or greater number of edges and corners are also contemplated as cross-sections of the gripping sections, in particular tetragons, pentagons, heptagons, octagons and nonagons. However, any other suitable number of edges and corners is contemplated.

When choosing an even number of corners of the polygon, however, a symmetrical layout of the gripping section 20 with respect to the brush head 3 can be achieved such that the gripping section 20 delivers a clear feedback with respect to the orientation of the brush head 3 within a 180° angle. As the brush head 3 has a substantially symmetrical layout with respect to the plane through the lateral extension of the brush head, a clear distinction within a 180° range is sufficient. In particular, it is not important to determine which of the two identical sides of the brush head 3 has a certain rotational orientation, it is rather the general orientation of the brush head that is of interest to the user.

The gripping section 20 of the handle 2 has a bulbous portion 26 with a section of maximum diameter 28. The term "bulbous portion 26" relates to an arrangement in which the handle has one section of a maximum diameter 28 but and all other sections towards both directions of the handle have a respective smaller diameter. The bulbous portion 26 leads to a substantially convex shape of the gripping section 20 along its longitudinal direction.

The portion of maximum diameter 28 of the bulbous portion is spaced apart by two thirds of the overall length of the handle 2 including the brush head 3, excluding the bristles, from the end of the handle 200 that does not carry the brush head. However any other suitable spacing is contemplated, e.g. one half of the overall length.

The bulbous portion 26, in combination with the polygonal cross-section of the gripping section 20, leads to an improved haptic feedback of the gripping section 20 towards the user. In particular, the user cannot only distinguish the rotational orientation of the brush 1 by means of the edges and corners of the polygon, but can also distinguish the longitudinal orientation of the brush 1 by means of the bulb and the portion of maximum diameter 28. Accordingly, a substantially one-to-one feedback is provided by the gripping section 20.

In addition to that, the provision of the bulbous portion 26 leads to a brush 1 which can be finely balanced, i.e. the weight distribution/mass distribution in the longitudinal direction of the gripping section 20 and, thus, of the brush 1 can be adapted to the needs of a user. By the provision of the bulbous portion 26 the centre of gravity can be shifted further towards that end 200 of the handle 2 that does not carry the brush head 3. The additional mass provided by the bulbous portion 26 counter-balances the weight of the brush head 3.

As also shown in FIGS. 1 to 3, the handle 2 tapers towards the end 200 which does not carry the brush head 3. Towards this end, the polygonal cross-section of the gripping section 20 smoothly merges into a basically circular cross-section. In other words, the edges 22 and corners 24 smoothly merge into a circular cross-section. The end 200 of the handle 2, which does not carry the brush head 3, has, thus, a basically circular cross-section.

The end 210 of the handle 2 which carries the brush head 3 also tapers slightly. In the transition zone between the handle and the brush head 3, two of the corners 24 of the top side (shown) as well as two of the corners 24 of the bottom side (not shown) of the gripping section 20 merge into one single corner 34, leading to a basically tetragonal cross-section at the end 210 of the handle 2 which carries the brush head 3.

The merging of the two corners 24 in the direction of the brush head 3 improves the haptic feedback for the user and informs the user of the orientation of the brush head 3 in an unambiguous manner.

In the embodiment shown in FIGS. 1 to 3, the gripping section 20 has a cross-section in the form of a polygon that has a larger number of corners than the cross-sections any other portion of the hair treatment brush, in particular more corners than the end 200 of the handle 2, the end 210 of the handle and the rigid part 30 of the brush head 3.

In particular when comparing FIGS. 2 and 3, the gripping section 20 with the bulbous portion 26 is visible and, additionally, it is shown that two of the corners 24 on the top side as well as on the bottom side merge towards the front end of the hair treatment brush into one single corner 34. The corner on the side, however, remains basically unchanged until it merges into the circular cross-section towards the end 200 of the hair treatment brush.

The rigid part 30 of the brush head 3 is integrally molded with the handle 2. This rigid part 30 includes a central portion 36 which extends in the plane orthogonal to the plane defined by the lateral extension of the brush head 3 and also extends along the longitudinal direction of the handle 2. The rigid part 30 of the brush head 3 has its widest extension/thickness in the central portion 36.

In other words, the rigid part 30 of the brush head 3 has a substantially wedge-shaped form, wherein the wedge includes an obtuse angle. The surfaces of the rigid part 30 of the brush head have, thus, a substantially convex shape. This wedge-shaped form of the rigid part 30 of the brush head 3 has the advantage that the color mass or any other hair treatment composition which, during application onto hair, typically remains in the center of the rigid part of a conventional brush head, is deviated or guided towards the lateral sides of the brush head 3 according to the present embodiment, which improves an even distribution of the colouring mass or the other hair treatment composition onto the actual bristles 32.

Bristles 32 in the form of bristle bundles are placed adjacent to each other in the plane defined by the rigid portion 30 of the brush head 3 and extend along the longitudinal direction of the handle.

FIGS. 4*a* to 4*e* show schematically the respective cross-sections of the hair treatment brush 1 at the respective positions.

FIG. 4*a* shows a schematic cross-section, in a plane perpendicular to the longitudinal extension of the handle 2, of the rigid part 30 of the brush head 3. The substantially wedge-shaped form of the rigid part 30 of the brush head 3 is clearly visible in this representation of the cross section.

FIG. 4*b* shows a schematic cross-section of the end 210 of the handle 2 in the section in which the two top corners and the two bottom corners have already merged into a single corner 34.

FIG. 4*c* shows a schematic cross-section of the gripping section 20, showing the general polygonal cross-section, in particular the hexagonal cross-section of the gripping section 20.

FIG. 4*d* shows the cross-section in the gripping section 20 in a position in which the polygonal cross-section starts to merge into the circular cross-section at the end 200 of the hair treatment brush.

FIG. 4*e* shows the cross-section of the handle 2 at the end 200, which does not carry the brush head 3 and clearly shows the circular cross-section.

In the representations of FIGS. 4*a* to 4*e*, it becomes clear that only the gripping section 20 has a hexagonal cross-section but the other sections have polygons with a fewer number of corners.

Figure 5:
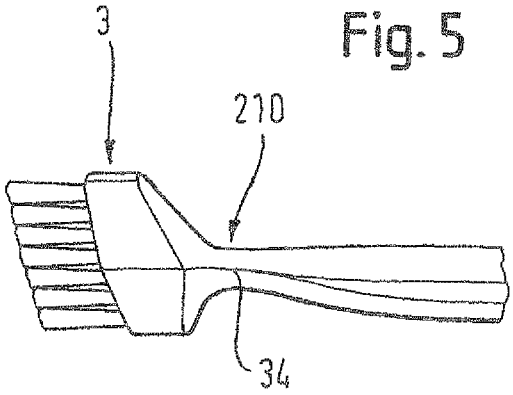
FIG. 5 is a schematic perspective view of the brush head of the hair treatment brush according to the previous Figures.
Figure 6:
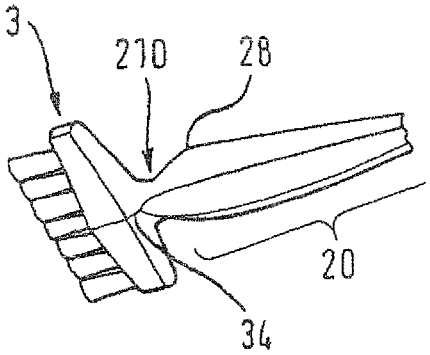
FIG. 6 is yet another schematic perspective view on the brush head of the hair treatment brush according to the previous Figures.

FIGS. 5 and 6 show perspective views of the brush head 3 as well as the bulbous part 26 of the gripping section 20 and of the transition at the end 210 of the handle towards the rigid part 30 of the brush head 3.

Figure 7:
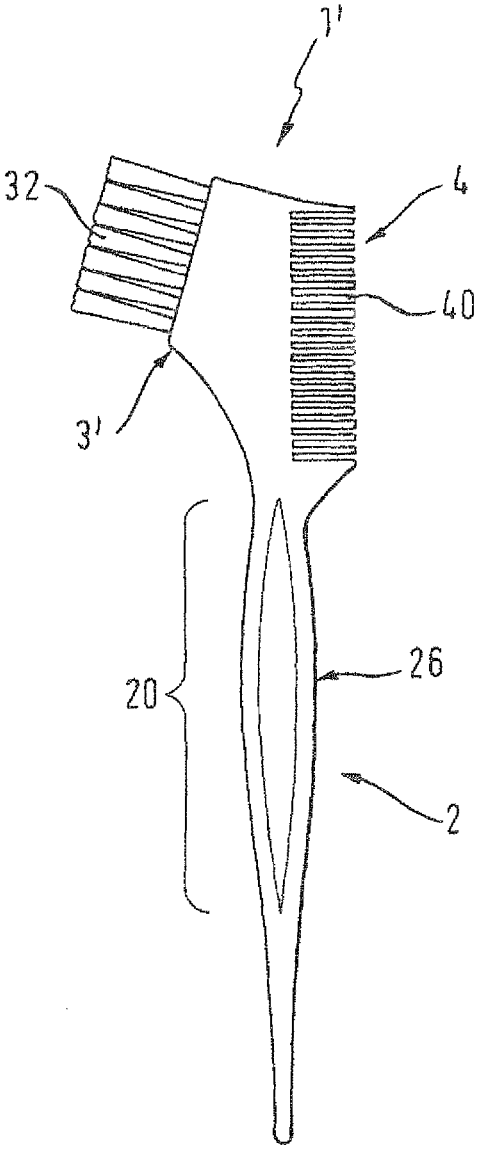
FIG. 7 is a schematic top view of another embodiment of a hair treatment brush in combination with a comb.

FIG. 7 shows, in a second preferred embodiment, a hair treatment brush 1' including a brush head 3' which includes bristles 32 and which also includes a comb 4 having comb teeth 40 which basically extend in a direction opposite to the extension direction of the bristles 32.

The handle 2 of the hair treatment brush 1' basically resembles the handle 2 as described with respect to the first embodiment above. In particular, a gripping section 20 with a bulbous portion 26 and a substantially hexagonal cross-section is present. In the sections of the handle which are not the gripping section 20, the cross-sections have fewer corners.

In other embodiments contemplated in this respect, the teeth 40 of the comb 4 may extend substantially perpendicular to the longitudinal extension of the handle 2. However, it is also contemplated that the bristles 32 substantially extend in an angle to the extension of the teeth 40 of the comb.

The embodiment shown in FIG. 7 has the advantage of providing the hair stylist with a combined tool for the application of a colouring mass or other hair treatment composition and a combing means in one single hair treatment brush.

The invention claimed is:

1. A brush for application of colours, dyes or other compositions onto a surface of hair, the brush comprising:

a handle configured to be held by a user; and a brush head comprising a rigid part holding bundles of bristles wherein the bundles of bristles are adjacent to one another in a plane defined by a largest lateral extension of the rigid part of the brush head, wherein the rigid portion of the brush head extends in a plane substantially orthogonal with respect to a longitudinal extension of the handle, wherein the rigid portion of the brush head has a substantially polygonal cross-section in the plane substantially orthogonal to the longitudinal extension of the handle, wherein the brush head is connected to the handle, wherein the handle comprises at least one gripping section having a substantially polygonal cross-section, wherein the at least one gripping section has a substantially bulbous portion and a substantially convex shape that extends along a longitudinal direction of the at least one gripping section, wherein the polygonal cross-section is one of a pentagon, a hexagon, a heptagon, an octagon or a nonagon, wherein the bundles of bristles of the brush head extend upwardly from rigid part of the brush head when the handle is located in an upright position.

2. The brush according to claim 1, wherein the polygonal cross-section of the at least one gripping section is one of a regular pentagon, a regular hexagon, a regular heptagon, a regular octagon or a regular nonagon.

3. The brush according to claim 2, wherein the polygonal cross-section is a hexagon.

4. The brush according to claim 1, wherein the handle tapers towards a first end of the handle that is located opposite with respect to the brush head.

5. The brush according to claim 4, wherein the polygonal cross-section of the at least one gripping section smoothly merges into a circular cross-section towards the first end of the handle.

6. The brush according to claim 4, wherein at least two corners of the polygonal cross-section of the at least one gripping section merge into a single corner in a portion of the handle located adjacent to the first end of the handle or a second end of the handle, wherein the second end of the handle is located opposite with respect to the first end of the handle.

7. The brush according to claim 4, wherein the polygonal cross-section of the at least one gripping section has a number of corners larger than a number of corners of any other polygonal cross-section of the handle.

8. The brush according to claim 4, further comprising a comb.

9. The brush according to claim 1, wherein a portion of the substantially bulbous portion or the substantially convex shape provides a maximum diameter of the handle at the at least one gripping section of the handle.

10. The brush according to claim 1, wherein the polygonal cross-section of the at least one gripping section comprises at least five straight sides.

11. The brush according to claim 1, wherein the substantially polygonal cross-section of the rigid portion of the brush head is a substantially wedge-shaped cross-section or a substantially convex-shaped cross-section.

12. A brush comprising:

a handle configured to be held by a user; and a brush head comprising bristles, the brush head being connected to the handle, wherein the handle comprises at least one gripping section having a substantially polygonal cross-section comprises at least three straight sides, wherein the at least one gripping section has a substantially bulbous portion and a substantially convex shape that is formed by the at least three straight sides of the substantially polygonal cross-section and extends along a longitudinal direction of the at least one gripping section wherein the at least three straight sides of the substantially polygonal cross-section of the gripping section comprises a front sides and a back side located opposite to the front side, wherein each of the front side and back sides have a length that is longer than lengths of the other sides of at least three straight sides of the substantially polygonal cross-section wherein the bristles of the brush head extend outward from the brush head and are located within a plane that is defined by the front and back sides of the at least one gripping section of the handle.

13. The brush according to claim 12, wherein the polygonal cross-section is one selected from the group consisting of a tetragon, pentagon, hexagon, heptagon, octagon and nonagon.

14. The brush according to claim 12, further comprising a comb.

15. A brush comprising:

a handle configured to be held by a user;

a comb having teeth extending in a first direction; and a brush head comprising bristles extending in a second direction, the brush head being connected to the handle, wherein the handle comprises at least one gripping section having a substantially polygonal cross-section comprising at least three straight sides, wherein the at least one gripping section has a substantially bulbous portion and a substantially convex shape that is formed by the at least three straight sides of the substantially polygonal cross-section and extends along a longitudinal direction of the at least one gripping section, wherein a portion of a maximum diameter of the substantially bulbous portion is spaced apart from an end of the handle, located opposite to the brush head, by no more than two-thirds of an overall length of the handle including the brush head, wherein the second direction of the bristles of the brush head is opposite with respect to the first direction of the teeth of the comb.

16. The brush according to claim 15, wherein the second direction of the bristles of the brush head is angled with respect to the first direction of the teeth of the comb.

* * * * *